US005788565A

United States Patent [19]

Chang

[11] Patent Number: 5,788,565

[45] Date of Patent: Aug. 4, 1998

[54] SMOKE EXHAUSTING DEVICE

[76] Inventor: Li-Lin Chang, No. 169-66, Hai-Pin Road, Ching Shui Chen, Taichung Hsien, Taiwan

[21] Appl. No.: 904,539

[22] Filed: Aug. 4, 1997

[51] Int. Cl.[6] ..... B08B 15/02

[52] U.S. Cl. ..... 454/67; 454/49; 454/345; 126/299 D

[58] Field of Search ..... 454/67, 49; 126/299 R, 126/299 D

[56] References Cited

U.S. PATENT DOCUMENTS

| | | | |
|---|---|---|---|
| 4,500,331 | 2/1985 | Cheng | 55/406 |
| 5,232,152 | 8/1993 | Tsang | 236/44 A |
| 5,372,122 | 12/1994 | Hong et al. | 126/299 R |
| 5,515,840 | 5/1996 | Jang | 126/299 R |
| 5,611,331 | 3/1997 | Phillips | 126/539 |
| 5,720,274 | 2/1998 | Brunner et al. | 126/299 D |

FOREIGN PATENT DOCUMENTS

| | | | |
|---|---|---|---|
| 0060140 | 4/1983 | Japan | 454/67 |

*Primary Examiner*—Harold Joyce
*Assistant Examiner*—Derek S. Boles
*Attorney, Agent, or Firm*—Rosenberg, Klein & Bilker

[57] ABSTRACT

A smoke exhausting device is disclosed. It includes a housing partitioned into two internal rooms. One of the rooms is a bellows for creating pressure, while the other is a guide box for guiding the smoke. The bellows has an entrance communicated with the guide box and an exit communicated with outer side of the housing. The guide box surrounds a front side, right side, left side and a bottom face of the bellows and is spaced from the bellows to define a path for air flow to smoothly pass therethrough. Each of the three sides is disposed with at least one sucking mouth, which is communicated with the entrance. A bottom of the housing is formed with a downward inclined oil guiding section having an oil outlet at bottom end. The housing can be easily disassembled from the funnel and the sucking mouths of the guide box can be disposed at different positions in different directions, so that the smoke exhausting device is applicable to different sites.

11 Claims, 15 Drawing Sheets

SMOKE EXHAUSTING DEVICE

BACKGROUND OF THE INVENTION

The present invention relates to a smoke exhausting device which is detachably assembled with a smoke collecting funnel.

FIG. 1 shows an existing smoke exhausting device including a smoke sucking apparatus 11 having an entrance 12 and an exit 13 which are fixedly directed. The smoke sucking apparatus 11 must be used together with a funnel body (not shown) so as to collectively suck a larger area of smoke. The entrance 12 and exit 13 of such smoke exhausting device have fixed direction so that it is impossible to use such device to laterally suck in or discharge smoke.

FIG. 2 shows a separation type smoke exhausting device in which a sucking motor 15 is installed outside a wall 16, while the housing 17 is disposed inside the wall. Accordingly, the noise from the sucking motor 15 is insulated outdoors. However, it is dangerous to install the sucking motor 15 outside the wall of a building. Also, it is difficult and dangerous to maintain or wash the sucking motor 15 thereafter.

FIG. 3 shows another type of smoke exhausting device 21 including two sucking fans. Such device can be more easily installed and washed. However, the device must be assembled in a funnel body 22 without separation.

SUMMARY OF THE INVENTION

It is therefore a primary object of the present invention to provide a smoke exhausting device including a housing partitioned into a bellows and a guide box. The sucking mouths of the guide box can be disposed at different positions in different directions to achieve better smoke sucking effect. The housing can be disassembled from the smoke collecting funnel so that the smoke exhausting device is applicable to different sites.

It is a further object of the present invention to provide the above smoke exhausting device in which one or more housings can be arranged side by side according to the size of the funnel or the distance for exhausting the smoke. Therefore, the resistance against the smoke sucking force is reduced to enhance the smoke exhausting effect.

The present invention can be best understood through the following description and accompanying drawings, wherein:

DETAILED DESCRIPTION OF THE PREFERRED EMBODIMENTS

Figure 2:
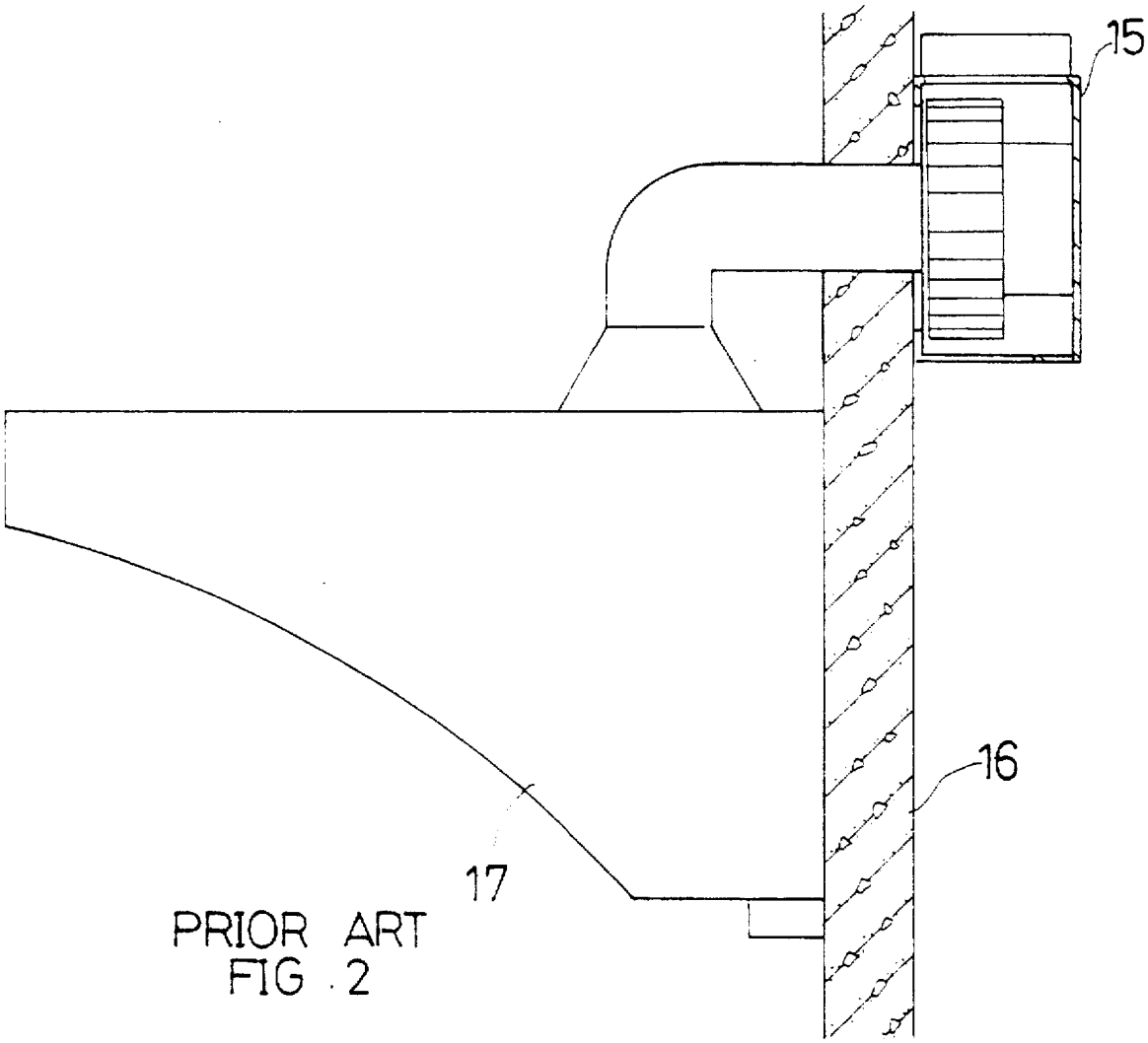
PRIOR ART FIG. 2
FIG. 2 shows another type of conventional smoke exhausting device.
Figure 1:
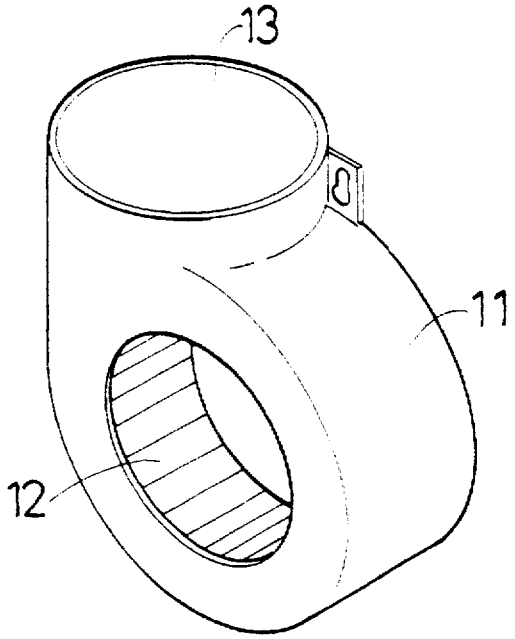
PRIOR ART FIG. 1
FIG. 1 is a perspective view of a conventional smoke exhausting device.
Figure 3:
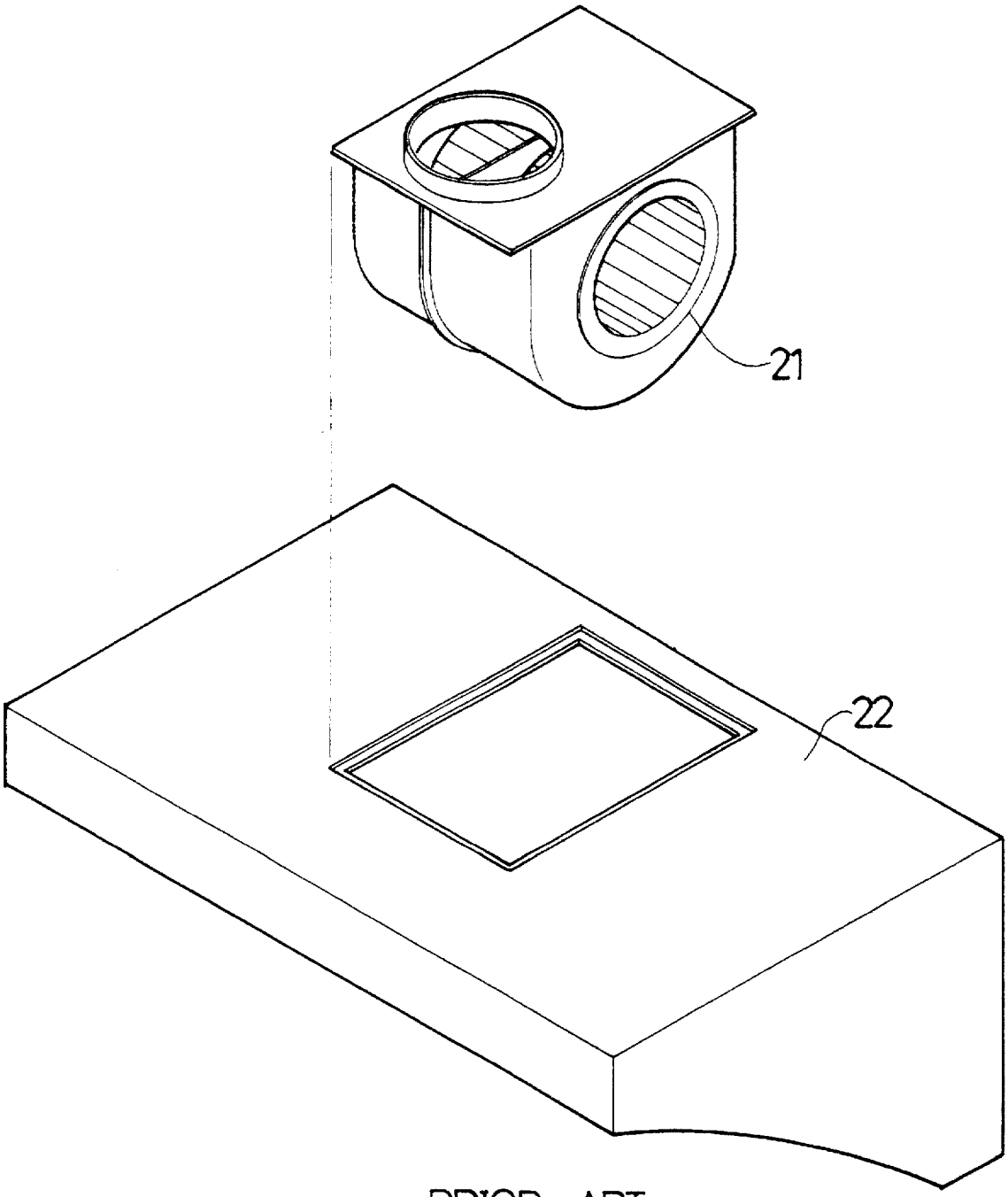
PRIOR ART FIG. 3
FIG. 3 is a perspective exploded view of still another type of conventional smoke exhausting device.
Figure 4:
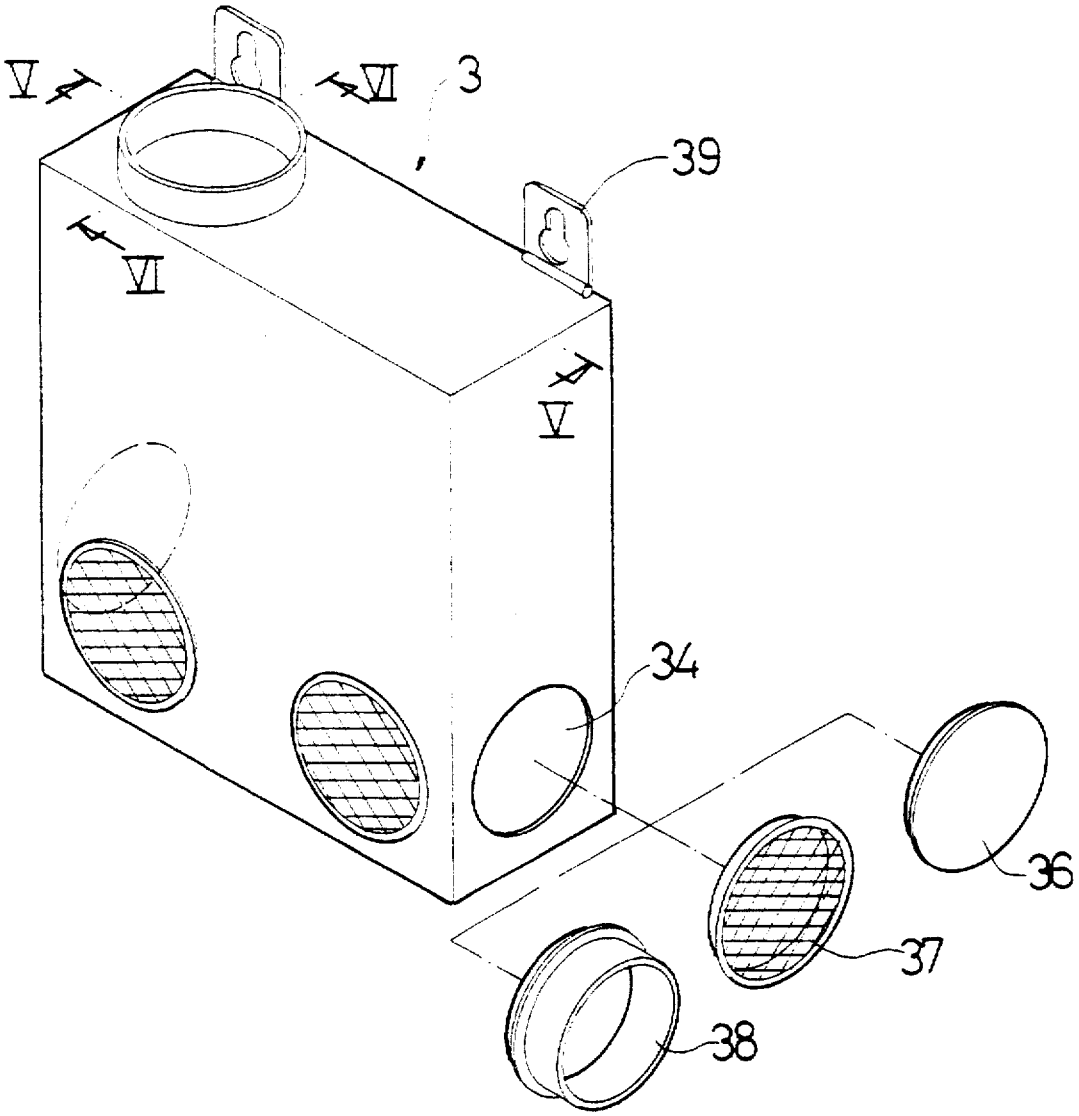
FIG. 4 is a perspective exploded view of the present invention.
Figure 5:
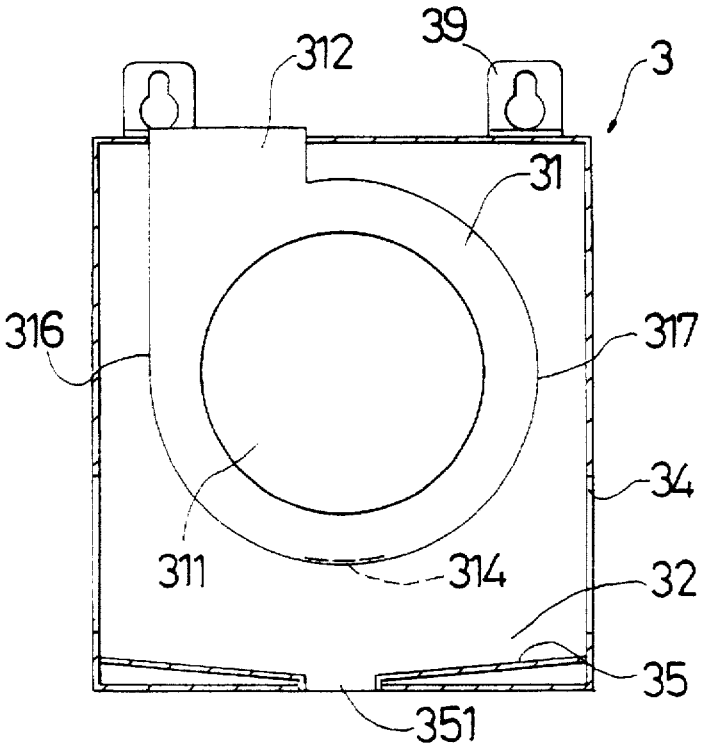
FIG. 5 is a sectional view taken along line V—V of FIG. 4.
Figure 6:
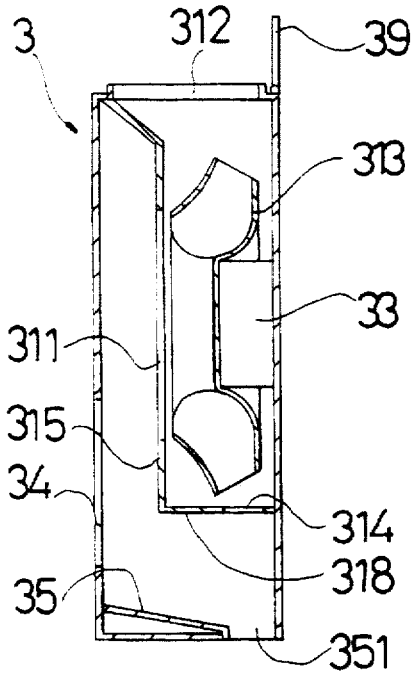
FIG. 6 is a sectional view taken along line VI—VI of FIG. 4.

Please refer to FIGS. 4 to 6. The present invention includes a housing 3 partitioned into two internal rooms. One of the rooms is a bellows 31 for creating pressure, while the other is a guide box 32 for guiding the smoke. The bellows 31 has an entrance 311 communicated with the guide box 32 and an exit 312 communicated with outer side of the housing 3. A fan 313 driven by a motor 33 is disposed in the bellows 31. The bottom of the bellows 31 is disposed with an oil draining opening 314. The guide box 32 surrounds a front side 315, right side 316, left side 317 and a bottom face 318 of the bellows 31 and is spaced from the bellows 31 to define a path for air flow to smoothly pass therethrough. Each of the three sides 315, 316, 317 is disposed with a sucking mouth 34 on the corner, which is communicated with the entrance 311. The bottom of the housing 3 is formed with a downward inclined oil guiding section 35 having an oil outlet 351 at bottom end.

The sucking mouth 34 of the housing 3 can be equipped with a mesh 37 or a cover member 36 for sealing the sucking mouth 34. Also, the sucking mouth 34 can be connected with other pipe member by a connector 38. The top end of the housing 3 is disposed with two hanging hooks 39.

Figure 7:
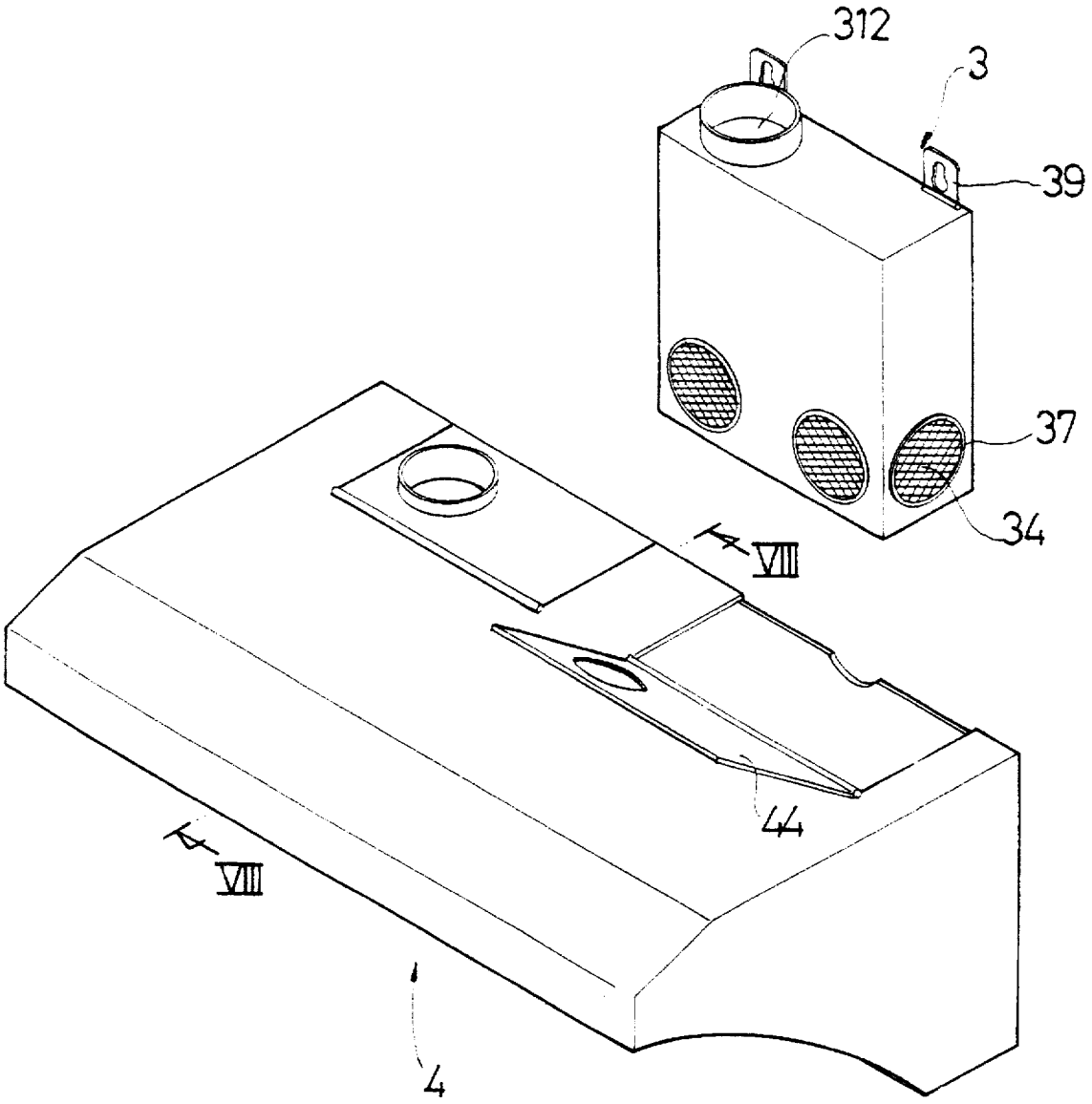
FIG. 7 is a perspective view of a first embodiment of the present invention.
Figure 8:
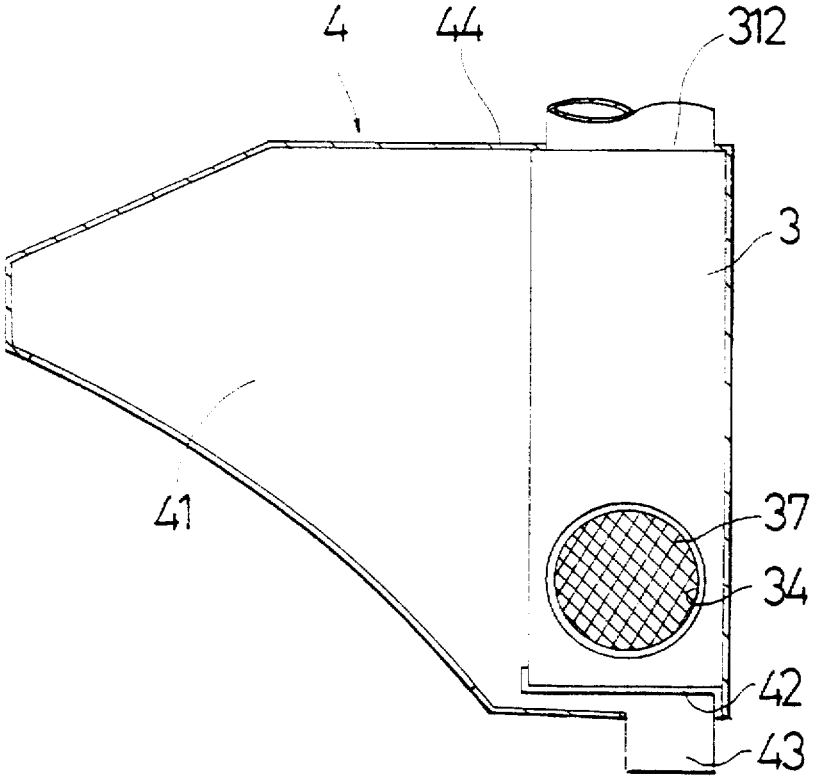
FIG. 8 is a sectional view taken along line VIII—VIII of FIG. 7.

Referring to FIGS. 7 and 8, when applied as a smoke exhausting device in kitchen, the present invention is used with a smoke collecting funnel 4. The top end of the funnel 4 is disposed with a movable cover board 44. The interior of the funnel is formed as a smoke collecting chamber 41. A locating seat 42 is disposed on rear side of the chamber 41 and an oil cup 43 is disposed at bottom end of the funnel 4.

In use, the funnel 4 is first fixed at a desired position. Then two housings 3 are respectively fixed on the locating seat 42 of the funnel 4 and connected with a ventilation pipe (not shown) which is conducted outside the wall. When smoke is produced during cooking, the fan 313 is driven by the motor 33 to rotate and create a sucking force, whereby the smoke is sucked from the sucking mouth 34 into the guide box 32 and then sucked from the entrance 311 into the bellows 31. The smoke in the bellows 31 is forced to inner side thereof to condense into oil drops. The oil drops flow from the oil draining opening 314 to the oil guiding section 35 of the guide box 32 and flow from the oil exit 351 into the oil cup 43. A mesh 37 can be disposed at the sucking mouth 34 for filtering the oil and protecting the fan 313.

Figure 9:
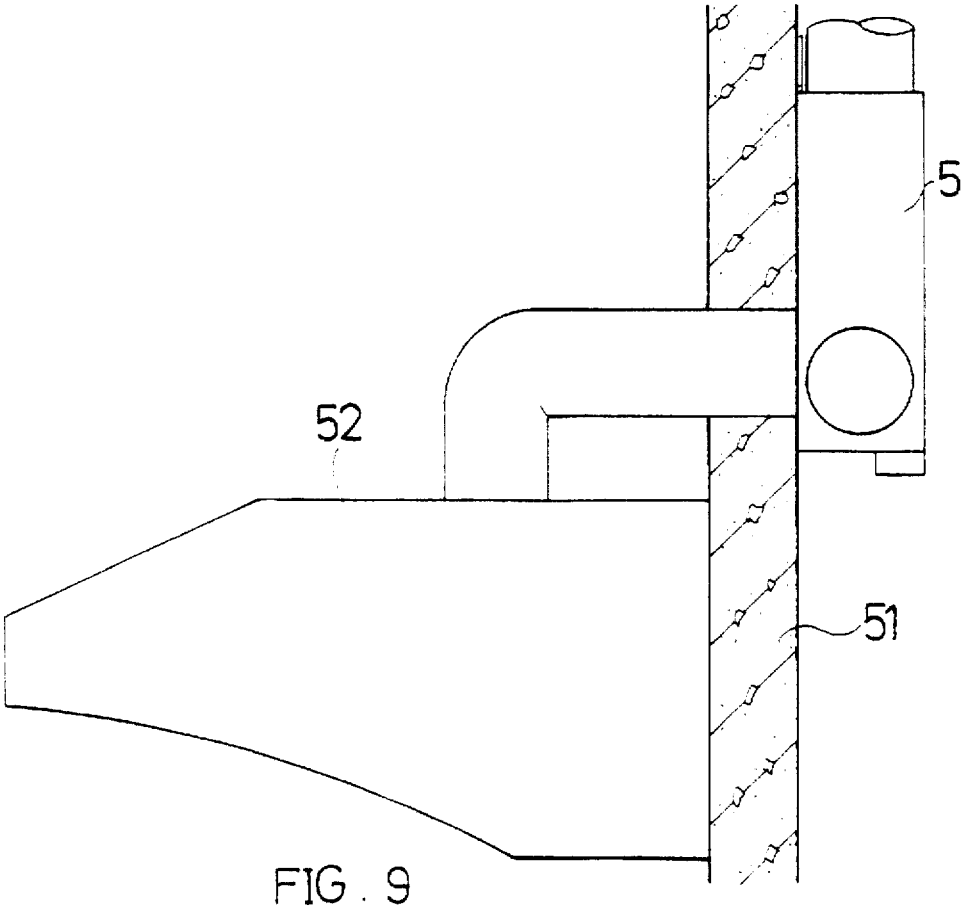
FIG. 9 is a side view of a second embodiment of the present invention.

Referring to FIG. 9, according to a second embodiment of the present invention, the housing 5 is installed on outer side of the wall 51 and the funnel 52 and the housing 5 are connected by a ventilation pipe 53.

Figure 10:
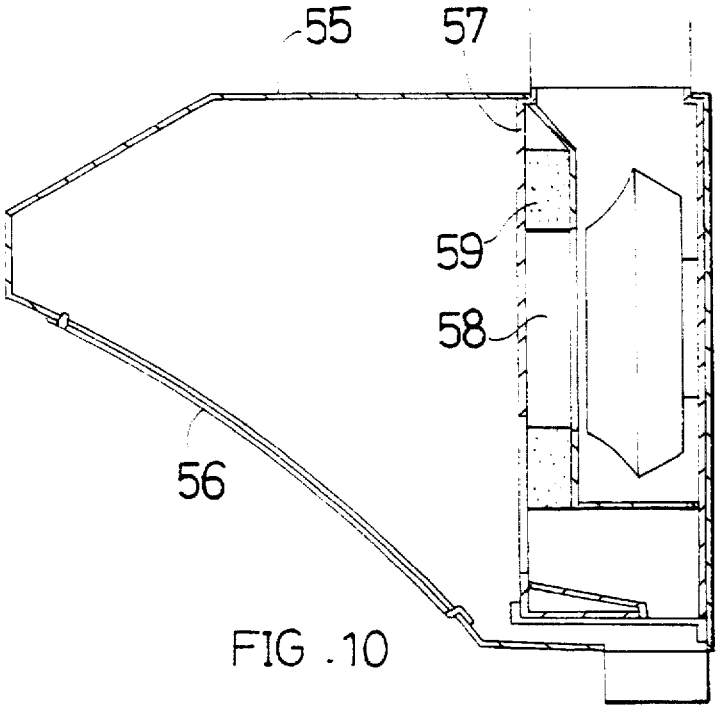
FIG. 10 is a side view of a third embodiment of the present invention.

Referring to FIG. 10, according to a third embodiment of the present invention, a filtering mesh 56 is disposed on bottom face of the funnel 55 and a filter 59 with activated carbon is disposed in the guide box 58.

Figure 11:
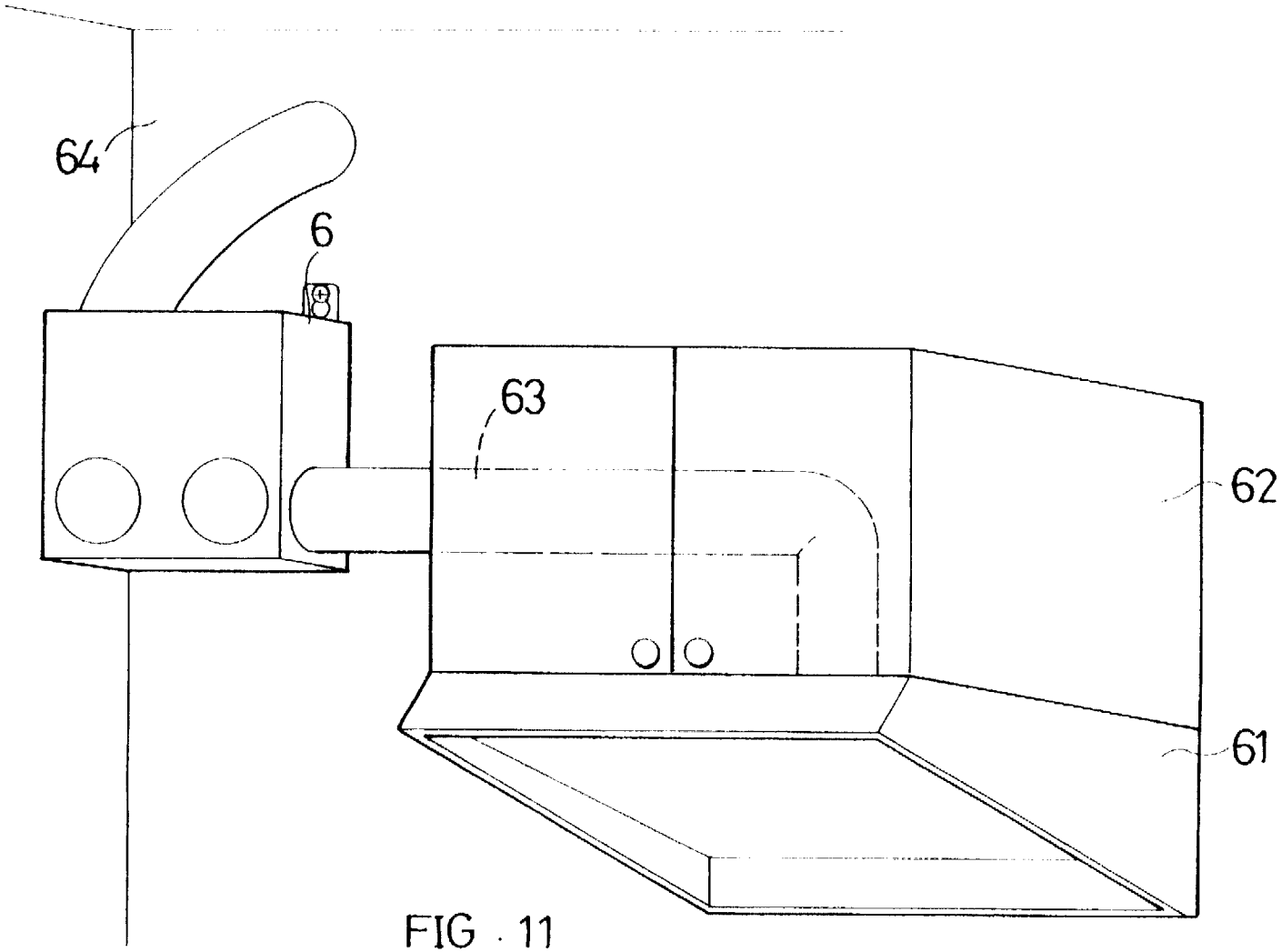
FIG. 11 is a perspective view of a fourth embodiment of the present invention.

FIG. 11 shows a fourth embodiment of the present invention, in which the housing 6 is separated from the funnel 61 and installed outside the kitchen cabinet 62. The housing 6 is connected with the funnel 61 by a ventilation pipe 63. Accordingly, the ventilation pipe 63 will not occupy the space of the kitchen cabinet 62.

Figure 12:
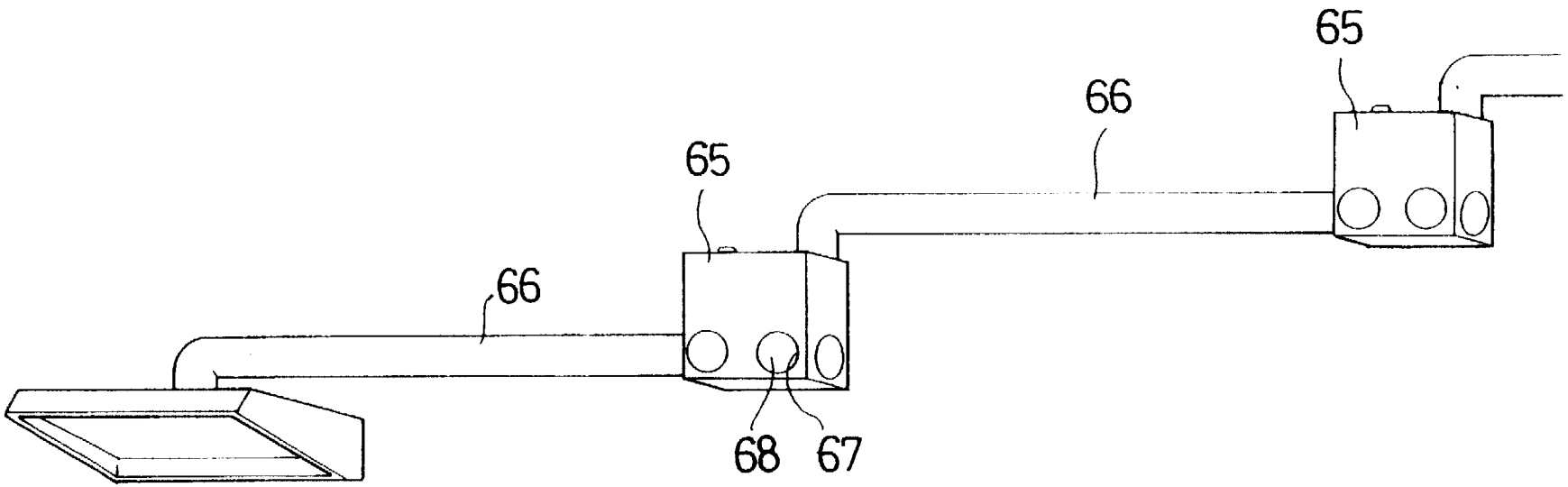
FIG. 12 shows a fifth embodiment of the present invention.

FIG. 12 shows a fifth embodiment of the present invention, in which in the case that there is a quite long distance between the housing 65 and outer side of the room and the ventilation pipe 66 is bent or too long so that a high resistance is created in the ventilation pipe 66, over two housings 65 can be installed at the middle or the end of the smoke path to increase the smoke exhausting force. The additional sucking mouth 67 of the housing 65 can be sealed by a cover body 68 to avoid leakage of smoke.

Figure 13:
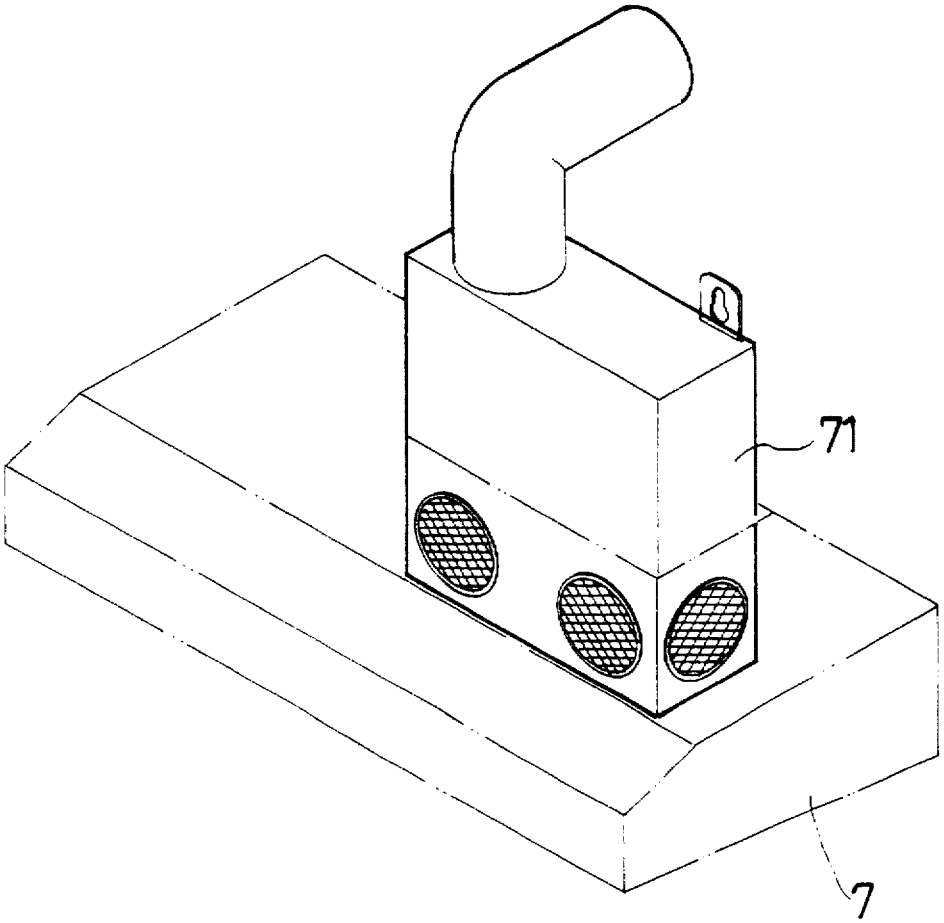
FIG. 13 is a perspective view of a sixth embodiment of the present invention.

FIG. 13 shows a sixth embodiment of the present invention, in which the funnel 7 has a thinner pattern and the housing 71 protrudes beyond the top end of the funnel 7. Such housing 71 is applicable to a thick or a thin funnel 7.

Figure 14:
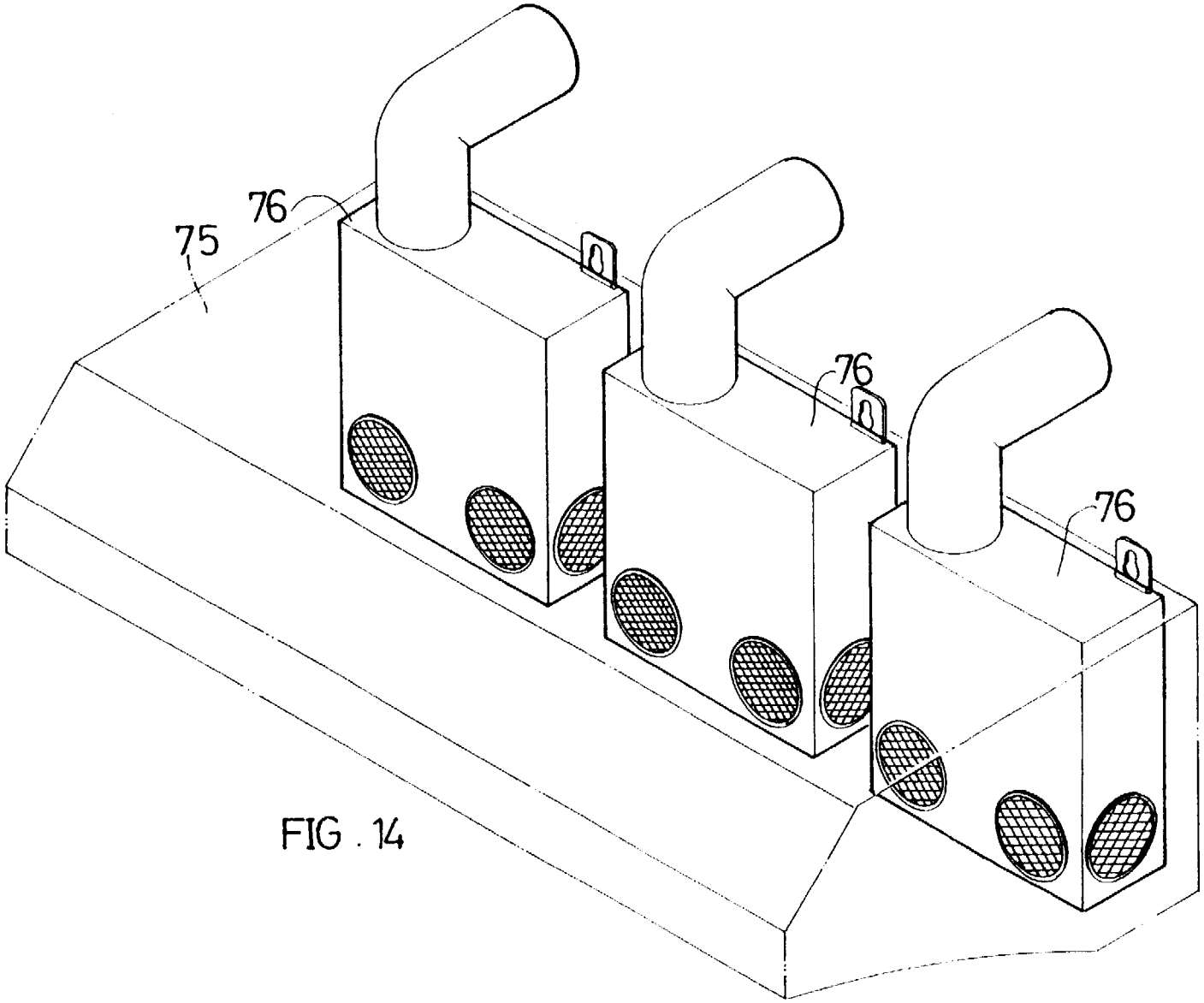
FIG. 14 is a perspective view of a seventh embodiment of the present invention.
Figure 15:
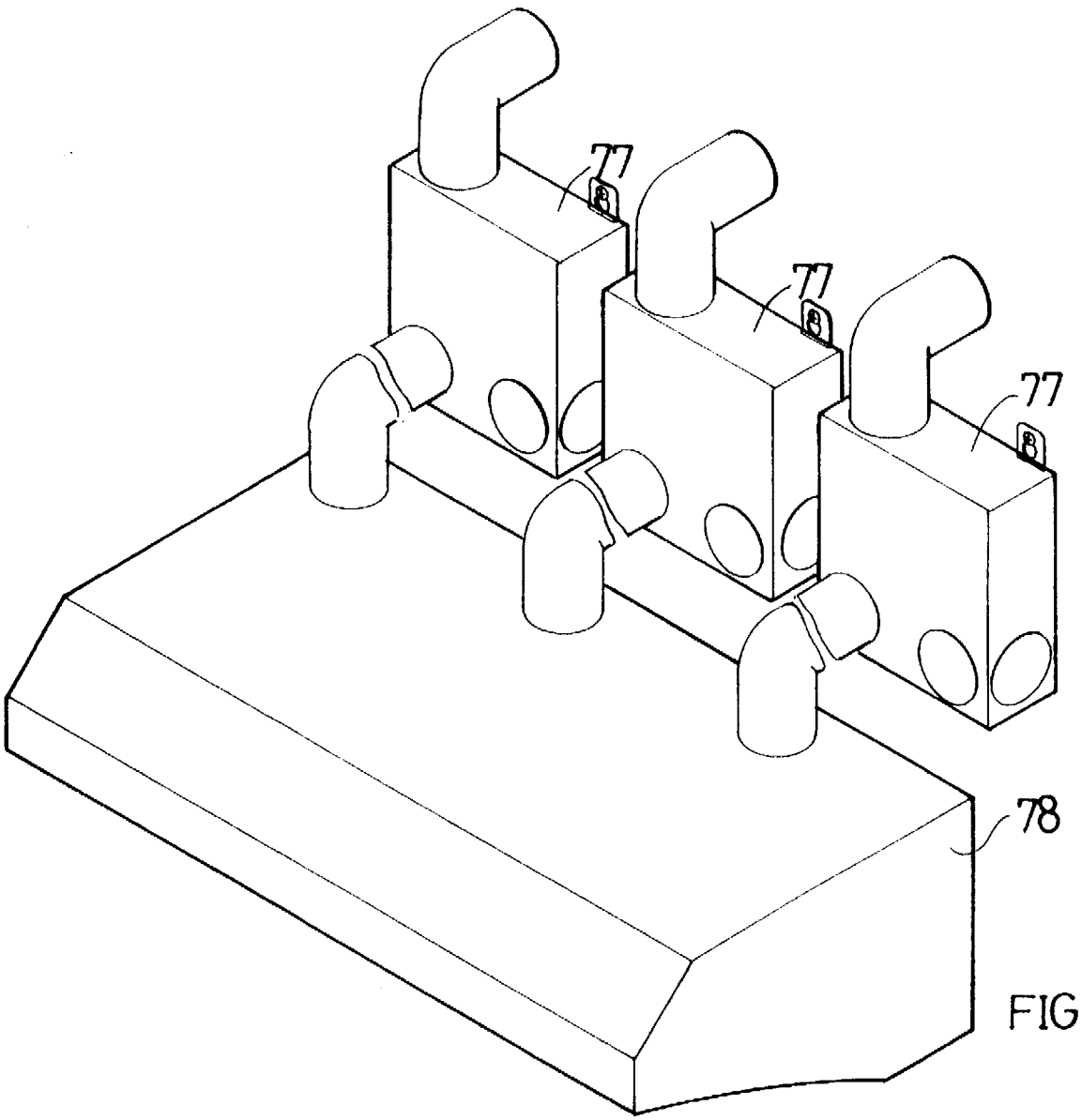
FIG. 15 is a view according to FIG. 14, wherein the housings are separated from the funnel.

FIG. 14 shows a seventh embodiment of the present invention, which is applicable to a kitchen of a restaurant. The funnel 75 is wider so that more housings 76 are installed on the funnel 75 side by side for sucking smoke covering a larger area. Similar to FIG. 15, in use, the housings 77 can be separated from the funnel 78.

Figure 16:
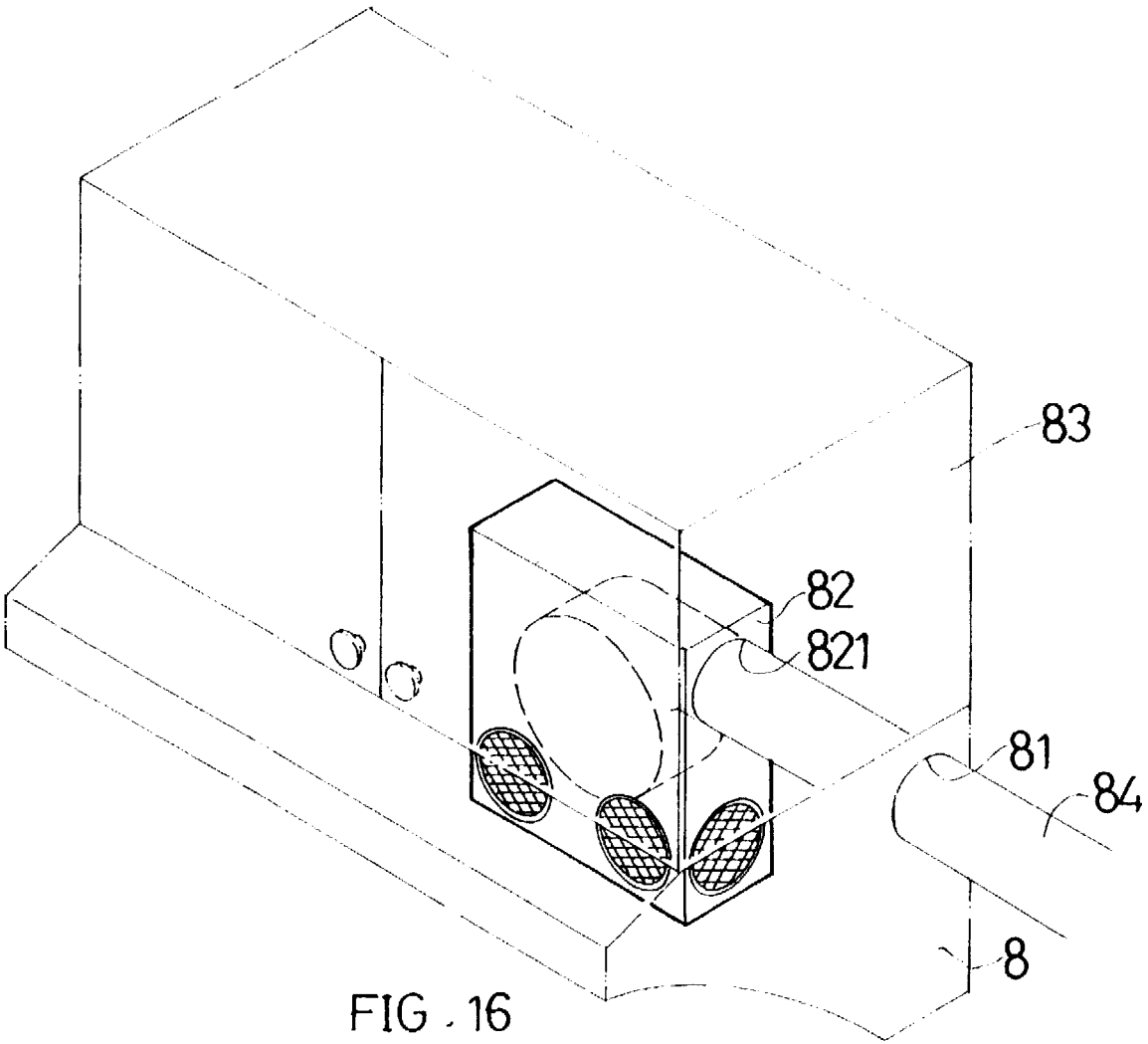
FIG. 16 shows an eighth embodiment of the present invention.

FIG. 16 shows an eighth embodiment of the present invention, in which one side of the funnel 8 is disposed with a smoke discharging opening 81 and the exit 821 of the housing 82 is disposed on the same side, whereby the collected smoke is discharged from one side. This will not affect the smoke exhausting effect. Also, the cabinet 83 is free from the ventilation pipe 84 so that more space of the cabinet 83 is saved for use.

Figure 17:
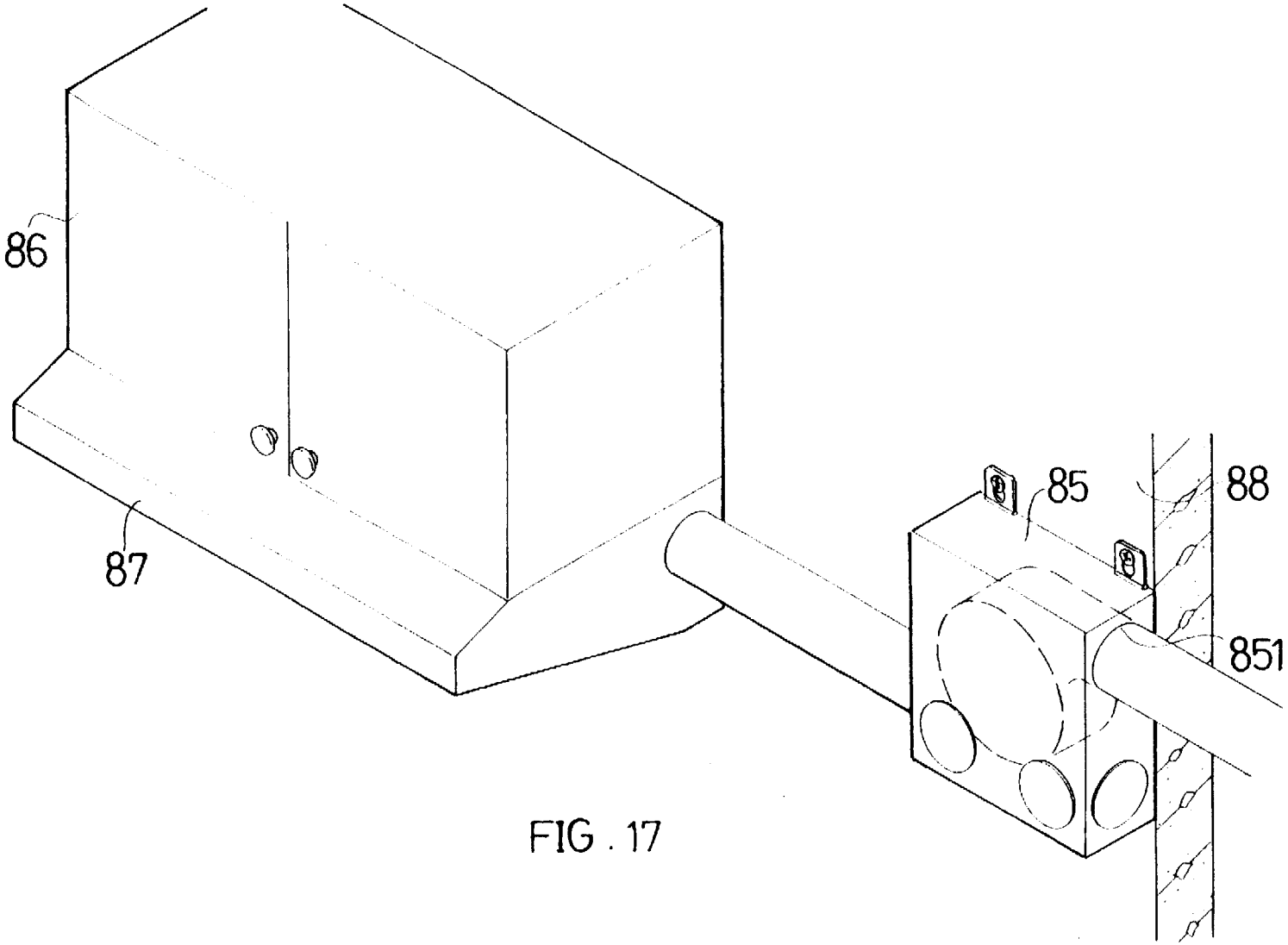
FIG. 17 is view according to FIG. 16, wherein the housing is separated from the funnel.

Referring to FIG. 17, in the above embodiment, the housing 85 is separated from the funnel 87 and installed on the wall 88 with the exit 851 disposed on one side thereof.

Figure 18:
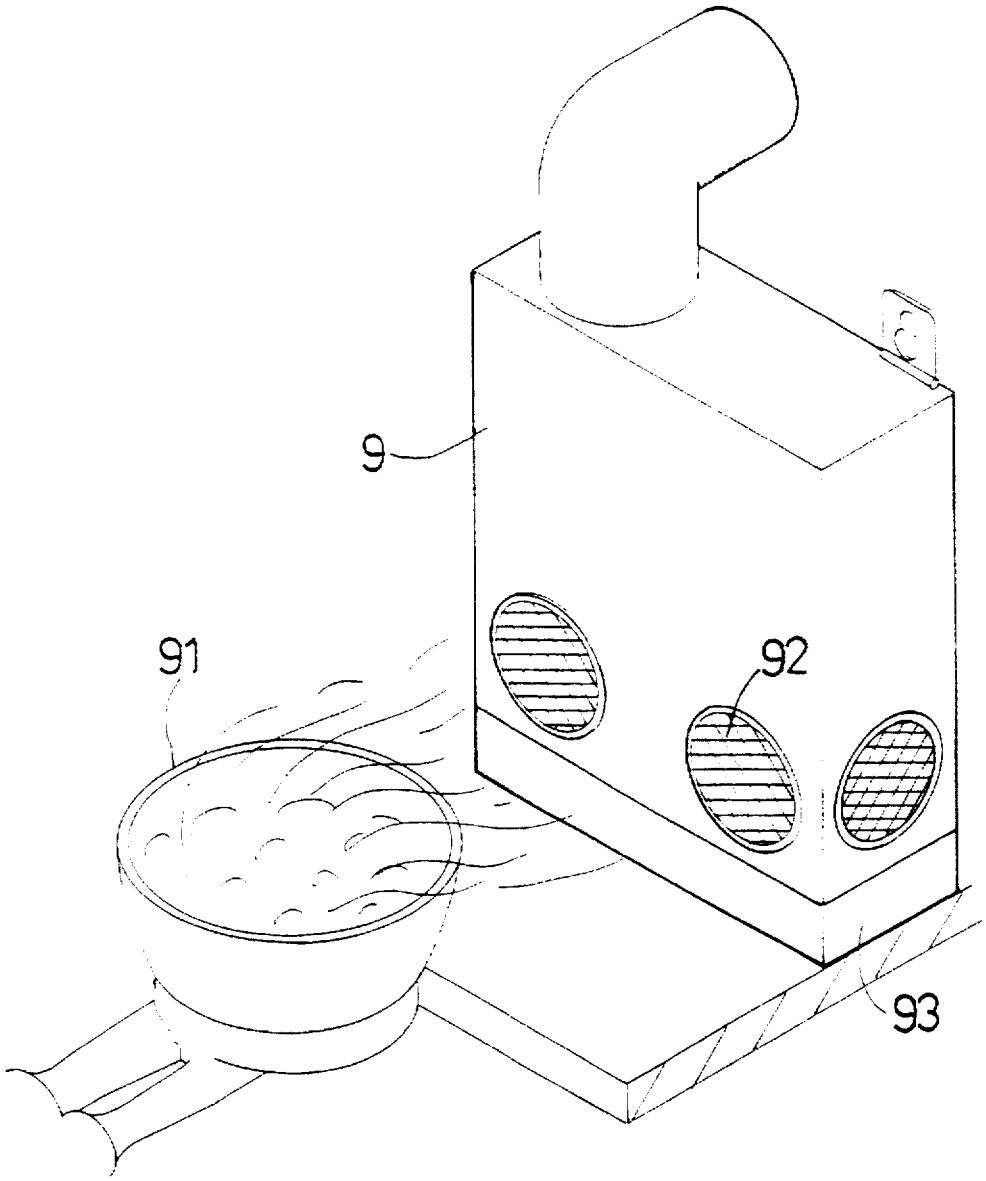
FIG. 18 shows a ninth embodiment of the present invention.

FIG. 18 shows a ninth embodiment of the present invention, in which the housing 9 is solely used in a bar-be-cue restaurant or directly installed beside a bar-be-cue oven 91. The sucking mouth 92 directly sucks the smoke produced from the oven 91. The oil drop is collected by the oil cup 93 at the bottom of the housing 9.

It is to be understood that the above description and drawings are only used for illustrating some embodiments of the present invention, not intended to limit the scope thereof. Any variation and derivation from the above description and drawings should be included in the scope of the present invention.

What is claimed is:

1. A smoke exhausting device comprising a housing partitioned into two internal rooms, one of the rooms being a bellows for creating pressure, while the other being a guide box for guiding the smoke, the bellows having an entrance communicated with the guide box and an exit communicated with outer side of the housing, a fan driven by a motor being disposed in the bellows, a bottom of the bellows being disposed with an oil draining opening, the guide box surrounding a front side, right side, left side and a bottom face of the bellows and being spaced from the bellows to define a path for air flow to smoothly pass therethrough, each of the three sides being disposed with at least one sucking mouth, which is communicated with the entrance, a bottom of the housing being formed with a downward inclined oil guiding section having an oil outlet at bottom end.

2. A smoke exhausting device as claimed in claim 1, wherein the sucking mouth is positioned on a corner of the housing.

3. A smoke exhausting device as claimed in claim 1, wherein the housing is disposed in a smoke collecting funnel which defines a smoke sucking chamber, a locating seat for the housing being disposed in the chamber.

4. A smoke exhausting device as claimed in claim 1, wherein a filter with activated carbon is disposed in the housing.

5. A smoke exhausting device as claimed in claim 3, wherein the bottom face of the funnel is disposed with a filtering mesh.

6. A smoke exhausting device as claimed in claim 3, wherein the bottom end of the funnel is disposed with an oil cup.

7. A smoke exhausting device as claimed in claim 1, wherein multiple housings are arranged side by side.

8. A smoke exhausting device as claimed in claim 1, wherein multiple housings are connected with each other by ventilation pipes.

9. A smoke exhausting device as claimed in claim 1, wherein the sucking mouth is sealed by a cover body.

10. A smoke exhausting device as claimed in claim 3, wherein one side of the funnel is disposed with a smoke discharging opening.

11. A smoke exhausting device as claimed in claim 1, wherein the bottom of the housing is disposed with an oil cup.

* * * * *